US011008162B1

(12) United States Patent
Stravitz et al.

(10) Patent No.: US 11,008,162 B1
(45) Date of Patent: May 18, 2021

(54) BABY AND ADULT-SAFE WASTE CONTAINER WITH BAG HANDLING ODOR CONTROL ASSEMBLY

(71) Applicant: Dooli Products, LLC, New York, NY (US)

(72) Inventors: David M. Stravitz, New York, NY (US); Alison L. Diamond, Hoboken, NJ (US)

(73) Assignee: Dooli Products, LLC, New York, NY (US)

( * ) Notice: Subject to any disclaimer, the term of this patent is extended or adjusted under 35 U.S.C. 154(b) by 0 days.

(21) Appl. No.: 16/990,012

(22) Filed: Aug. 11, 2020

Related U.S. Application Data

(60) Provisional application No. 62/969,329, filed on Feb. 3, 2020.

(51) Int. Cl.
*B65F 1/00* (2006.01)
*B65F 1/16* (2006.01)
*B65B 67/12* (2006.01)

(52) U.S. Cl.
CPC ..... *B65F 1/0013* (2013.01); *B65B 67/1227* (2013.01); *B65F 1/1607* (2013.01); *B65F 2001/1676* (2013.01); *B65F 2240/132* (2013.01)

(58) Field of Classification Search
CPC ..... B65F 1/0013; B65F 1/1607; B65F 2001/1676; B65F 2240/132; B65B 67/1227; A47G 29/083
USPC ..... 248/95, 99, 100, 558
See application file for complete search history.

(56) References Cited

U.S. PATENT DOCUMENTS 1,978,314 A 10/1934 Lancaster
2,426,911 A 9/1947 Williamson
3,180,384 A * 4/1965 Seifert ..... B60N 3/08 383/12
3,484,875 A * 12/1969 Eisenberg ..... A47K 11/04 4/484
4,483,095 A 11/1984 Webringer
4,537,377 A * 8/1985 Shewchuk ..... B65B 67/1244 248/99
4,644,610 A 2/1987 Fish
4,669,689 A * 6/1987 Jones ..... B65B 67/1227 248/152
5,016,753 A 5/1991 Henderson
(Continued)

FOREIGN PATENT DOCUMENTS

JP 2018002473 A * 1/2018

OTHER PUBLICATIONS

English translation of JP 2018002473.

*Primary Examiner* — Kimberly T Wood
(74) *Attorney, Agent, or Firm* — Brian Roffe

(57) ABSTRACT

Bag trapping apparatus includes a housing, a cord attached to the housing for enabling the housing to be suspended in a position elevated from an underlying horizontal surface, trapping structure on the housing for removably fixing an open upper end of a bag to the housing, and a slotted membrane through which the bag passes when the open upper end of the bag is trapped by the trapping structure. A bottom closed end of the bag is below the membrane so that waste is insertable into the bag through the membrane. The membrane provides odor control and a barrier. If a drawstring bag is used, a raised ridge may be provided on the housing to secure the drawstring.

20 Claims, 5 Drawing Sheets

(56) References Cited

U.S. PATENT DOCUMENTS

D332,203 S 1/1993 Fernandez-Guthrie
5,205,530 A 4/1993 Fish
5,226,551 A 7/1993 Robbins, III
5,439,128 A 8/1995 Fishman
5,573,129 A 11/1996 Nagata et al.
5,575,398 A 11/1996 Robbins, III
5,695,088 A 12/1997 Kasbohm
5,909,820 A 6/1999 Yeh
5,987,708 A 11/1999 Newton
6,364,146 B1 4/2002 Beckerer, Jr.
6,484,897 B1 11/2002 Crawley
6,612,099 B2 9/2003 Stravitz
6,666,329 B1 12/2003 Charbonneau
6,804,930 B2 10/2004 Stravitz
6,851,251 B2 2/2005 Stravitz
7,086,569 B2 8/2006 Stravitz
7,114,314 B2 10/2006 Stravitz
7,146,785 B2 12/2006 Stravitz
7,243,811 B1 7/2007 Ramsey
7,316,100 B2 1/2008 Stravitz et al.
7,434,377 B2 10/2008 Stravitz et al.
7,494,022 B2 2/2009 Buchalter et al.
7,503,152 B2 3/2009 Stravitz et al.
7,503,159 B2 3/2009 Stravitz et al.
7,617,659 B2 11/2009 Stravitz et al.
7,694,838 B2 4/2010 Yang et al.
7,708,188 B2 5/2010 Stravitz et al.
7,712,285 B2 5/2010 Stravitz et al.
7,641,835 B2 11/2010 Ramsey et al.
7,883,062 B2 * 2/2011 Zima ..... B65B 67/1205 248/99
7,963,414 B1 6/2011 Stravitz
8,061,546 B2 11/2011 Ramsey
8,127,519 B2 3/2012 Stravitz
8,215,089 B2 7/2012 Stravitz
8,235,237 B1 8/2012 Stravitz
8,266,871 B1 9/2012 Stravitz
8,393,489 B1 3/2013 Stravitz
8,844,751 B2 9/2014 Sakaguchi et al.
8,887,942 B2 11/2014 Miksovsky et al.
8,910,821 B1 12/2014 Stravitz
8,973,774 B1 3/2015 Stravitz
9,181,028 B1 11/2015 Stravitz
9,694,972 B1 7/2017 Stravitz
9,745,127 B1 8/2017 Stravitz
9,828,721 B2 11/2017 Silverman et al.
9,834,376 B1 12/2017 Stravitz
9,950,853 B2 4/2018 Irwin-Kieling et al.
9,994,392 B1 6/2018 Stravitz
10,053,283 B1 8/2018 Stravitz
10,053,284 B2 8/2018 Dunn et al.
10,081,481 B2 9/2018 Fernandez de Castro
10,099,855 B1 10/2018 Higgins, II
D838,606 S 1/2019 McConnell et al.
10,273,070 B2 4/2019 Perkins et al.
10,486,899 B1 11/2019 Stravitz
D878,699 S 3/2020 Sutton
10,710,799 B2 7/2020 Dunn et al.
10,711,417 B1 7/2020 Stinson
10,822,144 B2 11/2020 Mayer
10,827,887 B2 11/2020 Gombar
D907,874 S 1/2021 Cardon et al.
2003/0085227 A1 5/2003 Azzarello
2005/0056649 A1 3/2005 Simonson et al.
2005/0127074 A1 6/2005 Kusuma et al.
2006/0078411 A1 * 4/2006 Casab ..... B65F 1/1415 414/408
2007/0289772 A1 12/2007 Kuroda et al.
2008/0000912 A1 1/2008 Lin
2008/0264948 A1 10/2008 Kovacevich et al.
2009/0046955 A1 2/2009 Schember et al.
2009/0230135 A1 9/2009 Ghitza
2009/0230258 A1 * 9/2009 McFadden ..... B65B 67/1233 248/101
2010/0005762 A1 1/2010 Stravitz
2010/0140423 A1 6/2010 Davies et al.
2010/0176126 A1 7/2010 Shikano
2011/0100996 A1 5/2011 Dunn et al.
2011/0170807 A1 7/2011 Khubani
2011/0272419 A1 11/2011 Vanderberg et al.
2012/0211494 A1 8/2012 Morand
2013/0075406 A1 3/2013 Sakaguchi et al.
2013/0181000 A1 7/2013 Miksovsky et al.
2013/0264340 A1 10/2013 Zens
2013/0277364 A1 10/2013 Kusuma et al.
2014/0042168 A1 2/2014 Dunn et al.
2015/0041478 A1 2/2015 Abrams et al.
2015/0217900 A1 8/2015 Poulin
2015/0251795 A1 9/2015 Tsui
2015/0251808 A1 9/2015 Tsui
2015/0251809 A1 9/2015 Jasin
2015/0253055 A1 9/2015 Tsui
2015/0291309 A1 10/2015 McGregor
2016/0059990 A1 3/2016 Patikas-Bryant
2016/0167872 A1 6/2016 Dunn et al.
2016/0347503 A1 12/2016 Tsui
2018/0065778 A1 3/2018 Johnson
2019/0075973 A1 3/2019 Charleson et al.
2019/0085503 A1 3/2019 Tsui
2019/0119000 A1 4/2019 Tsui

* cited by examiner

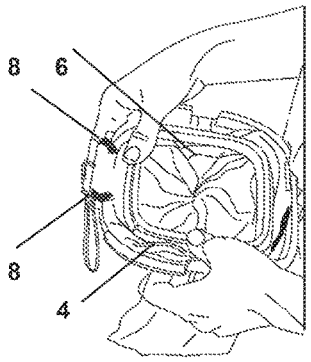
FIG 7
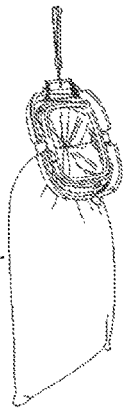
FIG 8
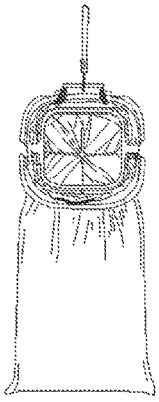
FIG 8A
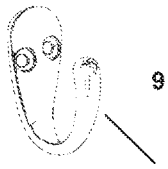
FIG 8B
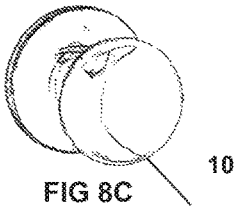
FIG 8C
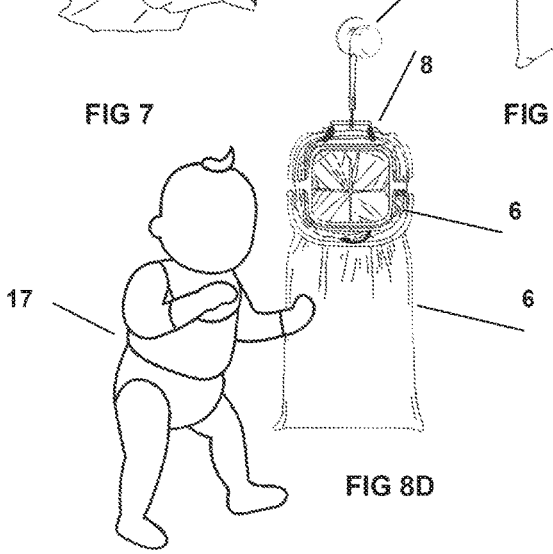
FIG 8D
FIG 9
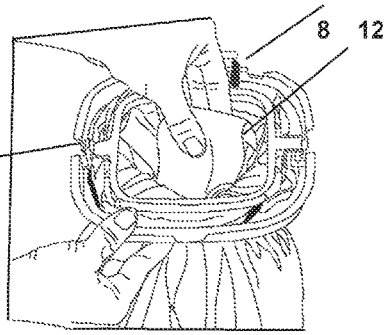

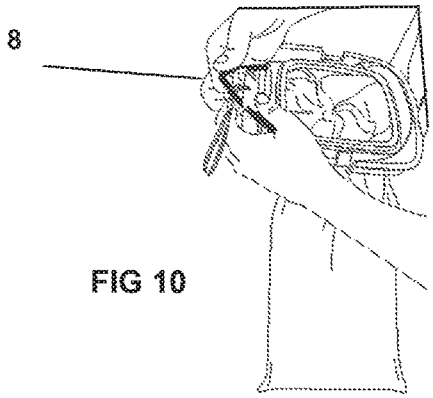
FIG 10
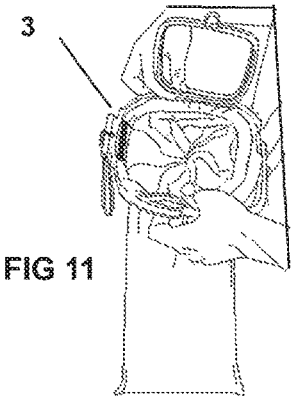
FIG 11
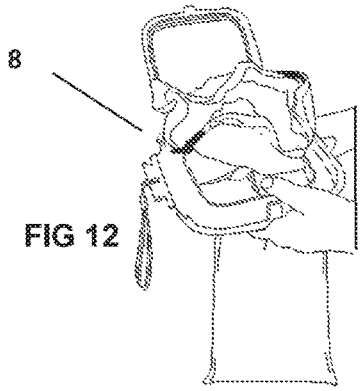
FIG 12
FIG 13
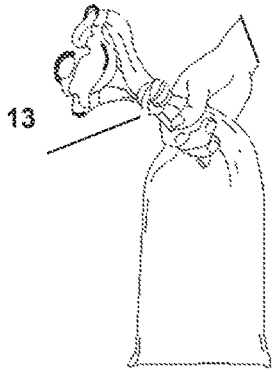
FIG 14
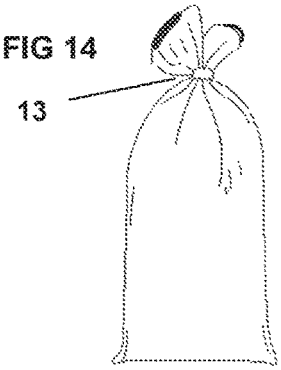

BABY AND ADULT-SAFE WASTE CONTAINER WITH BAG HANDLING ODOR CONTROL ASSEMBLY

FIELD OF THE INVENTION

The present invention relates generally to an odor control waste disposal devices that may be used for any type of waste, including but not limited to, baby and adult diapers, cat litter, medical waste from hospitals, doctors' offices, home health care personnel and facilities, nursing homes, biohazard laboratories, general household waste, disposables and the like.

The present invention also relates generally to waste disposal devices that include structure that securely retains or traps a hanging bag without the need for a rigid plastic or metal housing as in conventional waste receptacles, so that the hanging embodiment secures the bag with double trapped elements primarily, but not exclusively, for baby and toddler safety and does not fall. The present invention relates more specifically to an apparatus that provides a trapped, hanging secured bag with a slotted membrane to contain offensive odor and harmful matter safely inside.

BACKGROUND OF THE INVENTION

Waste disposal devices are common in nurseries, hospitals, doctors' offices, kitchens and other household locations and other locations where waste is generated and must be disposed of in a sanitary manner. Waste disposal devices are also often used to dispose of soiled diapers, household waste, cat litter and other pet waste. If the waste emits odors, the waste disposal device should also contain odors emanating from the waste.

Some waste disposal devices include a dispenser that dispenses tubing, and therefore include an internal ring-shaped flange on which a tubular core or cartridge rests and houses a continuous length of flexible, substantially non-resilient plastic tubing. A knot is tied at one end and the continuous tubing is pulled down to the bottom of the pail to form a bag for inserting one diaper after another until the bag is full. When full, the user cuts the top of the bag with a built-in blade and then ties a knot in the open area for subsequent removal. This procedure is once again repeated—tie the knot—fill the bag—remove the bag, etc. When the canister is depleted of bag lengths, one replaces the canister. Canisters are costly and require changing regularly.

Another disposal device utilizes a single use bag sealed at one end and is welded to a foldable plastic header at the open end. The header when opened flat rests securely in the pail to accept diapers as they fill up. Once full, the plastic header folds to seal the upper open area and at the same time forms a handle for convenient removal. These polypropylene living hinge headers are wasteful, costly to produce and require welding or bonding them to a one time use bag.

Numerous waste disposal devices exist including those disclosed in U.S. Pat. Nos. 6,612,099, 6,804,930, 6,851,251, 7,086,569, 7,114,314, 7,146,785, 7,316,100, 7,434,377, 7,503,152, 7,503,159, 7,617,659, 7,708,188, 7,712,285, 7,963,414, 8,127,519, 8,215,089, 8,235,237, 8,266,871, 8,973,774, 10,053,283, 10,486,899 and all of which are incorporated by reference herein. Additionally, innovative waste disposal devices are disclosed in U.S. patent application Ser. No. 12/172,715 filed Jul. 14, 2008, now abandoned, Ser. No. 13/172,976 filed Jun. 30, 2011, now abandoned, and Ser. No. 13/270,697 filed Oct. 11, 2011, now abandoned, all of which are incorporated by reference herein.

Some of these waste disposal devices include a base defining a waste-receiving compartment and a lid pivotally connected to the base. When the lid is opened, a bag becomes visible and waste is inserted into an opening of the bag. The bag often passes through a membrane that requires force to insert the waste, and also serves to close the bag above the waste providing a barrier to waste and odor outflow. In some waste disposal devices, the bag is actually part of an accordion-folded length of flexible tubing that is housed in a cartridge.

Further, some of these waste disposal devices include a step or foot pedal assembly to complement or replace the manual opening and closing of the lid. The foot pedal assembly includes a depressible foot pedal and a spring, and is arranged to cause both opening of the lid when the foot pedal is depressed and closure of the lid when the pressing force is removed. The spring is moved against its bias upon depression of the foot pedal and returns to its original state when the pressing force is removed to thereby cause closure of the lid and rotation of the twisting mechanism.

With respect to use of such waste disposal devices for babies and toddlers using diapers, the U.S. Consumer Product Safety Commission (CPSC) has received an average of about 25 reports a year describing deaths to children who suffocated due to plastic bags. Almost 90 percent of them were under one year of age. The bags used by dry-cleaners are especially hazardous because the thin plastic can easily conform to a small child's face and create an air-tight barrier. Garbage bags also have caused deaths annually when kids climbed into them or babies rolled onto them while sleeping or playing unattended. Unfortunately, a thin film of plastic can also kill a child by suffocating him/her. Dozens of children (mostly infants) are at risk every year because of plastic bags, including, but not limited to the above.

Often waste bags may simply be hanging on a hook and used to contain general waste as well as soiled diapers. Aside from not being child safe, none offer odor control functionality. Most have the drawstring as the sole hooking member and many are typically large in size as those made to fit 13 gallon pails or larger. These bags are so large that toddlers can get into serious trouble and danger should these larger bags be ripped apart from their hook.

The inventors with broad experience in this category feel that there is a need for a hanging embodiment to hang a drawstring bag that double traps the bag for extra child safety as well as provides an effective odor containment barrier membrane. Also, the inventors consider that a drawstring bag should be of a specific size that is no larger in size and circumference than is necessary to keep toddlers safe.

OBJECTS AND SUMMARY OF THE INVENTION

It is an object of at least one embodiment of the present invention to provide a new improved method for compact diaper disposal and a portable, compact diaper disposal apparatus.

It is another object of at least one embodiment of the present invention to provide a new and improved method for medical, pet, ambulatory safe odor and bacteria containment.

It is yet another object of at least one embodiment of the present invention to provide a substantially pail-less waste disposal system.

It is an object of at least one embodiment of the present invention to provide a level of baby and toddler safety when in contact with waste bags or film.

It is an object of at least one embodiment of the present invention to provide a tiny footprint, compact mobile waste containment system.

It is an object of at least one embodiment of the present invention to provide a waste containment odor containment system that hangs on a hook on a wall or doorknob off the floor.

It is an object of at least one embodiment of the present invention to provide a mobile, easy to transport odor control assembly.

It is an object of at least one embodiment of the present invention to provide a significant reduction in raw and finished materials without sacrificing the end results of human safe odor containment.

In order to achieve one or more of these objects, an improvement of a waste disposal system, to the myriad of conventional garbage pails, baby diaper disposable pails, floor standing disposable waste receptacles and the like, in accordance with the invention involves hanging a specific size drawstring garbage bag, trapping it in two places, one around the perimeter of the bag with a pivoting pinch ring and a second trap incorporating looping at least one portion of the drawstring around a raised ridge. If the first trap should fail, the looped drawstring provides a fail-safe condition and thus prevents the bag from being drawn down and being entirely separated from the hanging bag trapping embodiment.

The inventors discovered that earlier inventions to a common inventor, which substantially trap a bag and/or include a membrane that contains odor (see, e.g., U.S. Pat. Nos. 9,181,028, 9,694,972, 9,745,127, 9,834,376, 9,994,392, 10,053,283, and 10,486,899), are applicable to a substantially pail-less waste containment embodiment which eliminates the need for a waste pail entirely. In place of the structural, physical waste pail which has a liner in it and which a conventional drawstring garbage bag typically wraps around the inner liner, the inventors accomplish this same feature without the need and use of both the pail and the inner liner which is primarily plastic and typically is fractionally smaller. Rather, a wall bracket (hook) or door knob entirely replaces the costly pail and redundant liner. However, to avoid a situation where the drawstring bag is entirely open, the inventors provide an additional level of child and baby safety as a means and method of bag removal and tamper resistance.

More specifically, a bag trapping apparatus in accordance with the invention includes a housing, a cord attached to the housing for enabling the housing to have a suspended position not in contact with an immediately underlying horizontal surface below the housing when the housing is suspended by the cord, trapping structure on the housing for removably fixing an open upper end of a bag to the housing, and a slotted membrane through which the bag passes when the open upper end of the bag is trapped by the trapping structure. A bottom closed end of the bag is below the membrane so that when an aperture of the cord is around a doorknob of a door or around a hook, the apparatus is suspended therefrom and available for insertion of waste through the membrane.

A raised ridge may be provided on one side of the housing. The raised ridge operatively engages with a drawstring proximate the open upper end of the bag to secure the drawstring of the open upper end of the bag when the bag is trapped by the trapping structure and when the bag passes through the membrane. The raised ridge may be on a common side of the housing as a location at which the cord is connected to the housing. Also, the raised ridge includes an aperture through which the cord passes. The raised ridge may be elongate and include extensions at opposite ends, which improve retention of a drawstring when present on the bag.

In one embodiment, the trapping structure includes a pinch ring pivotally attached at a first location to the housing and having a first open position in which the pinch ring is separated at a second location from a corresponding structure on the housing and a second closed position in which the pinch ring is pivoted against the corresponding structure at the second location to press the bag when present between the pinch ring and the corresponding structure. A locking structure locks the pinch ring against the housing at the second location. The locking structure may be a tab on the pinch ring and a retainer on the housing.

Another embodiment of the bag trapping apparatus includes a housing, suspending structure attached to the housing for enabling the housing to have a suspended position not in contact with an immediately underlying horizontal surface below the housing when the housing is suspended by the suspending structure, trapping structure on the housing for removably fixing an open upper end of a bag to the housing, the trapping structure having a first position in which the open upper end of the bag is secured to the housing and a second position in which the open upper end of the bag is removable from engagement with the housing, and a membrane having at least one slot through which the bag passes when the open upper end of the bag is trapped by the trapping structure. The bottom closed end of the bag is below the membrane and forms a waste receptacle below the membrane when the housing is suspended by the suspending structure.

The same features of the bag trapping apparatus described above may be included in this embodiment as well.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein:

FIG. 7 is a view similar to that shown in FIG. 6, now trapping the full perimeter of the garbage bag.

FIG. 8 is a side view of the hanging bag trapped by both the pinch ring trapping the bag circumference as well as the drawstring over the raised ridge.

FIG. 8A is a front view of the hanging bag trapped by both the pinch ring trapping the bag circumference as well as the drawstring over the raised ridge.

FIG. 8B is an example of a wall hook from which the waste disposal apparatus in accordance with invention can be suspended.

FIG. 8C is an example of a doorknob from which the waste disposal apparatus in accordance with invention can be suspended.

FIG. 8D is a view of the waste disposal apparatus in accordance with invention hanging on a doorknob with a baby in proximity.

FIG. 9 is partial view showing insertion of waste though the bag and resilient odor barrier membrane of the waste disposal apparatus in accordance with invention.

FIG. 10 is a view showing the first step for removal of the bag when filled with waste, namely un-hooking the drawstring.

FIG. 11 is a view showing the second step for removal of the bag when filled with waste, namely releasing the locked pivoted pinch ring.

FIG. 12 is a view showing the third step for releasing the bag from both methods of trapping of the bag.

FIGS. 13 and 14 show the knotted bag removed entirely from the waste disposal apparatus in accordance with invention.

DETAILED DESCRIPTION OF THE INVENTION

Figure 1:
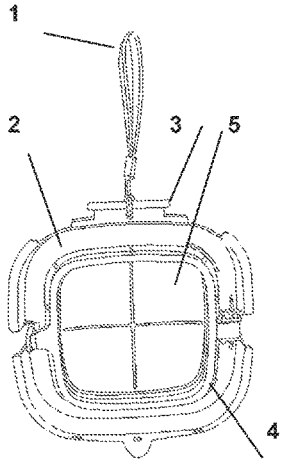
FIG. 1 is a frontal view of a waste disposal apparatus in accordance with the invention in a hanging position.

Referring to the accompanying drawings wherein the same reference numbers refer to the same or similar elements, FIG. 1 illustrates the bag trapping mechanism in accordance with the invention its entirety, comprising a hanging strap or cord 1, a housing 2 which comprises a raised ridge with protruding extensions 3, a bag trapping pivotable locking pinch ring 4 movably connected to the housing 2 and a slotted odor barrier resilient membrane 5 retained by the housing 2. The raised ridge with protruding extensions 3, the pinch ring 4 and membrane 5 may be considered parts of the housing 2 or separate elements.

The strap or cord 1 is often an elongate piece of material thereby inherently having a first end region (at which it is attached or connected to the housing 2) and a second end region opposite the first region, and flexible, forming a loop, often called a lanyard. The strap or cord 1 may have an adjustable loop, which is obtained in a manner known to those skilled in the art to which this invention pertains. The strap or cord 1, as well as the attached rope, is preferably no larger a loop than is necessary to secure (at the second end region) the dimensions of a typical door knob (see FIGS. 8C and 8D), so as to prevent unforeseen injury to toddlers or babies, for example. Also, the securely attached rope of the strap or cord 1 is preferably not larger than is necessary to secure the strap or cord 1 (at the first end region) through a hole 1*a* in a flange of the housing 2 alongside the raised ridge with protruding extensions 3 (see FIG. 16).

The strap or cord may be considered to constitute suspending structure or suspending means which are attached to the housing 2 for enabling the housing 2 to have a suspended position not in contact with an immediately underlying horizontal surface below the housing 2 when the housing 2 is suspended by the suspending structure, e.g., on a doorknob hook or other component or structure elevated from the immediately underlying horizontal surface. All comparable or equivalent structure that performs the same function in substantially the same way to achieve the substantially the same result is considered to be encompassed by the term suspending structure or suspending means.

The housing 2 may be similar to housing of other bag handling assemblies by a common inventor, David M. Stravitz, which bag handling assemblies are disclosed in the patents mentioned above.

The raised ridge with the protruding extensions 3 is situated on one side of the housing 2, what may be considered the top of the housing 1. The strap or cord 1 extends through an aperture in a flange between a main part of the housing 2 and the raised ridge leaving a portion of the protruding extensions on each side of the strap or cord 1. The flange may be planar and flat and extend over only a portion of the length of the top side of the housing 2.

The pinch ring 4 may be similar to the pinch ring of other bag handling assemblies by a common inventor, David M. Stravitz, which pinch rings are disclosed in the patents mentioned above. All features of the pinch rings disclosed in these patents may be provided for the pinch ring 4 herein.

The pinch ring 4 cooperates with structure on the housing 2 to trap a bag when engaged with the bag trapping apparatus in accordance with the invention. This combination of structure, i.e., the pinch ring 4 and cooperating structure, may be considered to constitute bag trapping structure or bag trapping means that removably fix an open upper end of a bag to the housing 2. All comparable or equivalent structure that performs the same function in substantially the same way to achieve the substantially the same result is considered to be encompassed by the term trapping structure or trapping means.

The membrane 5 may be similar to the membrane in or for use in other bag handling assemblies by the common inventor, David M. Stravitz, which membranes are disclosed in the patents mentioned above. All features of the membranes disclosed in these patents may be provided for the membrane 5 herein. Stating that a bag passes through the slotted membrane means that the bag passes through the slots of the membrane defined between folds or part of the membrane that are separated by spaced apart interior walls of the membrane.

Figure 2:
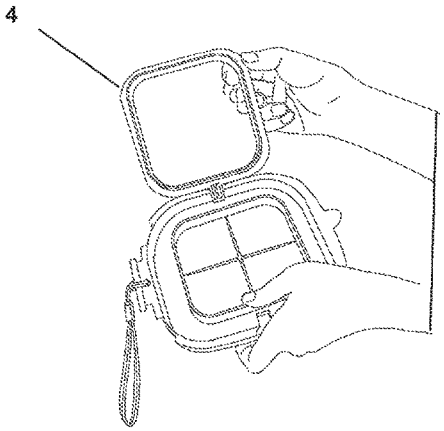
FIG. 2 is a view of the waste disposal apparatus in accordance with invention with the pinch ring in the open position.

FIG. 2 shows the components of FIG. 1 with the pivotable pinch ring 4 in an open state, i.e., pivoted upward about a hinge having cooperating hinge parts on the housing 2 and the pinch ring 4. The pinch ring 4 is maintained in connection with the housing 2 when pivoted into the open position from the closed, bag-pinching position.

Figure 3:
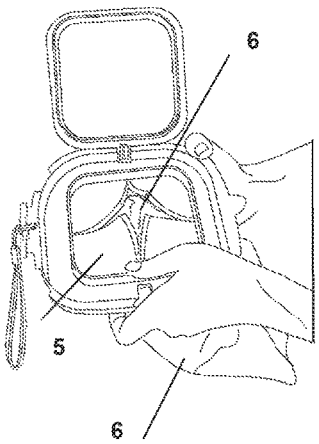
FIG. 3 is a view of the flexing of the resilient odor trapping membrane of the waste disposal apparatus to insert a bag therethrough.

In FIG. 3, a drawstring bag 6 is inserted through membrane 5 as one such means to begin to trap the drawstring bag 6 for subsequent double engagement. While it is possible to use a bag without the added drawstring component, the extra level of baby-safe feature (provided by the presence of the drawstring) will be missing. Therefore, this invention specifically preferably includes the need for bags of the drawstring design. As known to those skilled in the art, a drawstring bag typically has a loop of material through a folded-over edge portion of the bag material. FIG. 3 also shows the folds of the membrane 5 separated from one another about separation lines.

Figure 4:
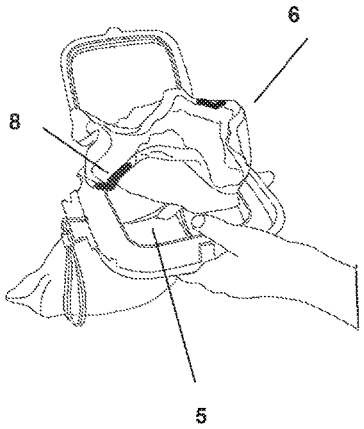
FIG. 4 show acceptance of the specific sized drawstring garbage bag inserted through the membrane of the waste disposal apparatus.

Referring to FIGS. 4-7, which continues the methods for double safety, primarily directed to child safety, of the bag trapping mechanism and method. FIG. 4 shows the drawstring bag 6 partially through the membrane 5, i.e., through the space formed when the folds of the membrane 5 are pushed apart from one another, and exposing the drawstring 8 of the drawstring bag 6.

Figure 5:
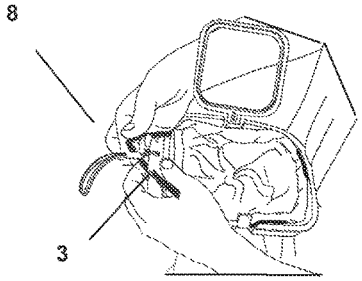
FIG. 5 is a view showing looping a portion of the drawstring around the raised ridges.
Figure 6:
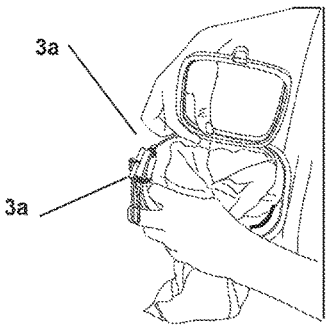
FIG. 6 is a view showing the portion of the drawstring around the raised ridge prior to trapping the bag with the pinch ring.

FIG. 5 shows the pinch ring 4 in the open position and the drawstring 8 being looped around both ends of the raised ridge 3. FIG. 6 shows the drawstring 8 looped tightly around the raised ridge 3 that has the added protections of the left and right extensions 3*a*. The extensions 3*a* add a level of accidental disengagement prevention of the drawstring 8 from engagement with the raised ridge 3. FIG. 7 shows the pinch ring 4 locked over the drawstring bag 6 with the drawstring 8 looped snugly over the raised ridge 3 in FIG. 5 and under the extensions 3*a* in FIG. 6.

FIGS. 8 and 8A show two views of the hanging bag trapping mechanism with a drawstring bag 6 and trapped with two means for bag trapping methods. FIG. 8B is an example of a hook 9 and FIG. 8C is an example of a doorknob 10 in which hanging strap 1 loops around the hook 9 or doorknob 10 as an example. FIG. 8D shows a walking baby 17 approaching the hanging drawstring bags of FIGS. 8 and 8A hanging on doorknob 10.

The drawstring bag 6 is trapped with two levels of anti-removal protection, namely raised ridge 3 and extensions 3*a*, as well as pivotable pinch ring and positive lock engagement or component 4 and 11, respectively, as shown in FIG. 9. FIG. 9 shows the force of inserting a diaper 12 through the drawstring bag 6 (see FIG. 7), and showing the drawstring 8 secured in place over the raised ridge 3, as well as the drawstring bag 6 is trapped with the pinch ring 4 being positively locked by component 11. The locking component 11 is referred to herein as corresponding structure in that it has a configuration that corresponds to the shape and/or form of part of the pinch ring 4 to provide for a secure engagement of the free end of the pinch ring 4, that end opposite the pivot location, to the housing 2.

The positive lock component 11 may be provided by a tab on the pinch ring 4 and a retainer on the housing 2 (as disclosed in other patents by the common inventor, David M. Stravitz, mentioned herein). This cooperating tab and retainer constitute locking structure or means for locking a portion of the pinch ring that is moved relative to the housing against the housing when in one position, i.e., a closed or locking position. Typically, the tab (positive lock component 11) and retainer are situated on an opposite side of the pinch ring 4 from that side at which the pinch ring 4 is pivotally connected to the housing 2.

FIGS. 10-13 which illustrate an exemplifying method for safe bag removal when the drawstring bag 6 is filled with waste and ready for removal, or it is otherwise desired to remove the drawstring bag 6. FIG. 10 illustrates lifting the drawstring 8 over the raised ridge 3. FIG. 11 shows the drawstring 8 released from the raised ridge 3 and the pinch ring 4 released to expose the top of the drawstring bag 6 above the odor barrier membrane 5. FIG. 12 shows the availability of sufficient room above the membrane 5 for the drawstring bag 6 to tie an odor sealing knot for odor-free removal. FIGS. 13 and 14 are two examples of the tied bag that was removed safely from the invention.

Figure 15:
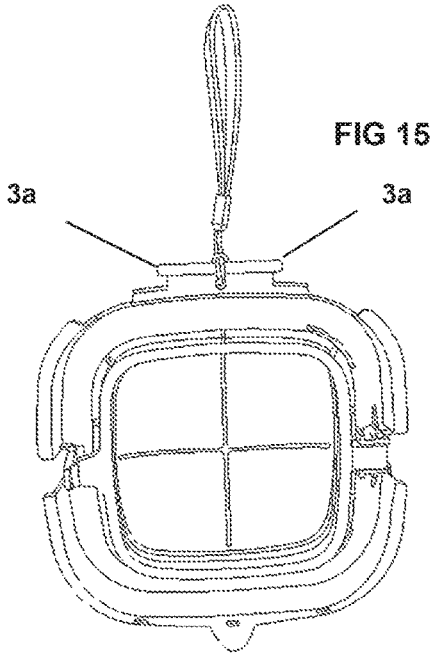
FIG. 15 is a frontal view of the invention showing one raised ridge design with two protruding extensions.
Figure 16:
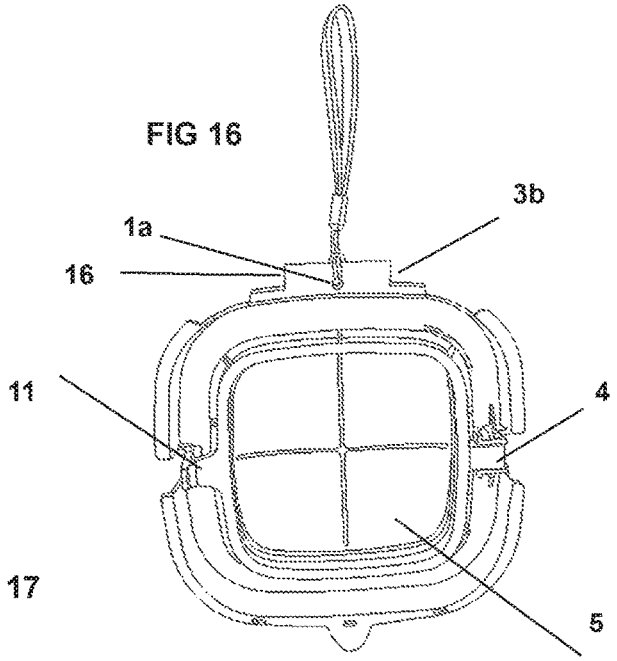
FIG. 16 is yet another view of the waste disposal apparatus in accordance with invention showing the raised ridge design without the protruding extensions.
Figure 17:
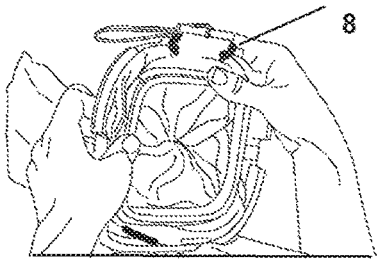
FIG. 17 is a closer view of the drawstring bag trapped by both the locking pivoting pinch ring and the looped drawstring engaging the raised ridge of FIG. 15.

FIG. 15 is a front view of the embodiment that illustrates an example of the two extensions 3*a* that allow a more positive trapping of the looped drawstring 8 (see also FIG. 17). FIG. 16 is substantially like FIG. 17 but without the extensions 3*a* (see the area designated 3*b*). Furthermore, FIG. 16 has the hanging hole 1*a* for the strap 1 and illustrates the pinch ring 4 and locking component 11 of the pinch ring 4 in locking component 11. FIG. 17 invention shows the bag 6 trapped by the pivotable pinch ring 4 and additionally supporting to drawstring 8 as an added level of safety and support.

For the above-described use, the parent or other user places the drawstring bag 6 through the resilient odor sealing membrane 5 and afterwards ultimately traps the bag 6 with the pivotable pinch ring 4, but before that, they loop the portion of the exposed drawstring 8 of the drawstring bag 6 over the raised ridge 3 which adds a substantial level of safety should the toddler 17 be in reach of the bag 6 (see FIG. 8D). Should the toddler 17 grab the bag 6 and draw it downward such that it disengages from the pinch ring 4 trapping the perimeter of the bag 6, the bag 6 will resist being separated and removed entirely because the looped drawstring portion wrapped around the raised ridge 3 will stop and resist the bag 6 from entirely being removed and subsequently endangering the toddler 17 or baby.

Ideally, it is preferable to use a bag that is substantially the proper size to fit the hanging bag trapping embodiment. As such, bags with no more than openings of about 10.5" flat (about 21" perimeter) should be used (at least in embodiments corresponding to the dimensions and shape of the illustrated embodiment). While the looping of the drawstring bag 6 over the raised ridge 3 for safety precautions, having bags of this size or smaller will make it quite difficult for toddlers to negotiate this compact size in general. The proper directed engagement of the drawstring 8 of the drawstring bag 6 being looped properly will insure this to be positive safety measures. For example, a one year old's head circumference is on average 18.25" (46.35 cm) and a 1.5 year old toddler's circumference is in the range of 19" and a 2 year old approaches 20" circumference. For the invention it is preferable that the bags be no larger in circumferential opening than about 21" and that they be with drawstring designs.

Unlike a significant number of the above-referenced patents, applications and known embodiments, the invention eliminates the plastic or metal housing for the bag or liner that encloses the waste bag around its periphery, e.g., the plastic inner liner, as well as the foot pedal or any structure relating to conventional waste receptacles requiring marrying a conventional or specific garbage bag to a substantial rigid housing. Rather, the invention comprises a bag that is positively secured to a bag trapping housing containing a substantially one-directional slotted membrane that receives the waste and at the same time forms an odor barrier keeping the offensive odor in the bag below. Furthermore, when using a preferably custom size drawstring bag, the embodiment (invention) provides double insurance that a toddler cannot easily pull the hanging bag down which can be problematic and dangerous. The invention, when used for children will have preferably defined sizes to further minimize injury (suffocation)

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention. Indeed, all of the features and structure disclosed in the other patents and patent applications by the common inventor, David M. Stravitz, that are mentioned above may be incorporated in the bag trapping apparatus of the claimed invention, e.g., those features relating to the membrane, those features relating to the pinch ring, those features relating to the pinch ring locking structure, and those features relating to the construction of the housing.

The invention claimed is:

1. A bag trapping apparatus, comprising:

a housing;

trapping structure on said housing for removably fixing an open upper end of a bag when present to said housing and thereby providing a first engagement between the bag and said housing;

a cord, separate from the bag, attached to said housing when the bag is not present for enabling said housing to have a suspended position not in contact with an immediately underlying horizontal surface below said housing when said housing is suspended by said cord, said cord enabling said housing to have the suspended position when said trapping structure is not fixing the bag to said housing;

an elongate raised ridge on only one side of said housing, said raised ridge including an aperture through which said cord passes and extensions at opposite longitudinal ends; and a slotted membrane coupled to said housing and through which the bag when present passes when the open upper end of the bag is trapped by said trapping structure, a bottom closed end of the bag being below said membrane when the bag passes through said membrane, wherein said raised ridge is, when the bag is present and said cord passes through the aperture in said raised ridge, configured to further engage with a drawstring of the bag proximate the open upper end of the bag and enable the drawstring to loop over said raised ridge and under said extensions to enable securing of the drawstring to said housing when the bag is present and trapped by said trapping structure and thereby provide a second engagement between the bag and said housing.

2. The apparatus of claim 1, wherein said raised ridge is on a common side of said housing as a location at which said cord is attached to said housing.

3. The apparatus of claim 1, wherein said cord is elongate and is attached at a first end region to said housing and defines an aperture at a second end region opposite the first end region having a size to fit around a doorknob of a door or around a hook.

4. The apparatus of claim 1, further comprising a locking structure for locking said trapping structure against said housing.

5. A kit including the apparatus of claim 1 and the drawstring bag having a loop of material through a folded-over edge portion of bag material to thereby provide the drawstring.

6. The apparatus of claim 1, wherein said trapping structure includes a pinch ring pivotally attached at a first location to said housing and having a first open position in which said pinch ring is separated at a second location from a corresponding structure on said housing and a second closed position in which said pinch ring is pivoted against said corresponding structure at the second location to press the bag when present between said pinch ring and said corresponding structure.

7. The apparatus of claim 6, further comprising a locking structure for locking said pinch ring against said housing at the second location.

8. The apparatus of claim 7, wherein said locking structure comprises a tab on said pinch ring and a retainer on said housing.

9. The apparatus of claim 8, wherein said tab and said retainer are, when engaged, on an opposite side of said housing from a side at which said pinch ring is pivotally attached to said housing and which sides are different than the side on which said raised ridge is situated.

10. A bag trapping apparatus, comprising:

a housing;

trapping structure on said housing for removably fixing an open upper end of a bag when present to said housing, said trapping structure having a first position in which the open upper end of the bag when present is secured to said housing and a second position in which the open upper end of the bag when present is removable from engagement with said housing;

suspending structure, separate from the bag, attached to said housing when the bag is not present for enabling said housing to have a suspended position not in contact with an immediately underlying horizontal surface below said housing when said housing is suspended by said suspending structure;

a membrane coupled to said housing and having at least one slot through which the bag when present passes when the open upper end of the bag is trapped by said trapping structure, a bottom closed end of the bag being below said membrane and forming a waste receptacle below said membrane when said housing is suspended by said suspending structure; and an elongate raised ridge on only one side of said housing, said raised ridge being configured to engage with a drawstring of the bag proximate the open upper end of the bag to enable securing of the drawstring to said housing when the bag is trapped by said trapping structure and passes through said membrane, and wherein said raised ridge is elongate and includes extensions at opposite longitudinal ends to enable the drawstring to loop over said raised ridge and under said extensions to enable securing of the drawstring to said housing when the bag is present and trapped by said trapping structure and passes through said membrane.

11. The apparatus of claim 10, wherein said raised ridge is on a common side of said housing as a location at which said suspending structure is attached to said housing.

12. The apparatus of claim 10, wherein said raised ridge includes an aperture through which said suspending structure passes.

13. The apparatus of claim 10, wherein said suspending structure comprises an elongate strap or cord attached at a first end region to said housing and defining an aperture at a second end region opposite the first end region having a size to fit around a doorknob of a door.

14. The apparatus of claim 10, wherein said suspending structure comprises an elongate strap or cord attached at a first end region to said housing and defining an aperture at a second end region opposite the first end region having a size to fit around a hook.

15. The apparatus of claim 10, further comprising a locking structure for locking said trapping structure against said housing.

16. The apparatus of claim 10, wherein said trapping structure includes a pinch ring pivotally attached at a first location to said housing and having a first open position in which said pinch ring is separated at a second location from a corresponding structure on said housing and a second closed position in which said pinch ring is pivoted against said corresponding structure at the second location to press the bag when present between said pinch ring and said corresponding structure.

17. The apparatus of claim 16, further comprising a locking structure for locking said pinch ring against said housing at the second location.

18. The apparatus of claim 17, wherein said locking structure comprises a tab on said pinch ring and a retainer on said housing.

19. The apparatus of claim 18, wherein said tab and said retainer are, when engaged, on an opposite side of said housing from a side at which said pinch ring is pivotally attached to said housing and which sides are different than the side on which said raised ridge is situated.

20. A bag trapping apparatus, comprising:

a housing;

trapping structure on said housing for removably fixing an open upper end of a bag when present to said housing;

a cord, separate from the bag, attached to said housing when the bag is not present for enabling said housing to have a suspended position not in contact with an immediately underlying horizontal surface below said housing when said housing is suspended by said cord;

a raised ridge on only one side of said housing, said raised ridge being elongate and including extensions at opposite ends to enable a drawstring of the bag to loop over said raised ridge and under said extensions; and a slotted membrane coupled to said housing and through which the bag when present passes when the open upper end of the bag is trapped by said trapping structure, a bottom closed end of the bag being below said membrane when the bag passes through said membrane.

* * * * *